US005791007A

United States Patent [19]

Tsai

[11] Patent Number: 5,791,007

[45] Date of Patent: Aug. 11, 1998

[54] TOOTHBRUSH WITH ADJUSTABLE DOUBLE BRUSH HEADS

[76] Inventor: I-Lung Tsai, No. 34, Lane 61, Chung-Shan Rd., Lu-Chou Hsiang, Taipei Hsien, Taiwan

[21] Appl. No.: 839,642

[22] Filed: Apr. 15, 1997

[30] Foreign Application Priority Data

May 17, 1996 [TW] Taiwan ..... 85207344

[51] Int. Cl.[6] ..... A46B 15/00; A46B 9/10

[52] U.S. Cl. ..... 15/167.2; 15/167.1; 15/172; 15/201

[58] Field of Search ..... 15/167.2, 167.1, 15/172, 201, 160, 22.2, 22.1, 22.4

[56] References Cited

U.S. PATENT DOCUMENTS

| | | | |
|---|---|---|---|
| 1,709,262 | 4/1929 | Henderhan | 15/167.2 |
| 2,232,269 | 2/1941 | Reuben | 15/172 |
| 2,411,610 | 11/1946 | Aaron | 15/172 |
| 2,682,066 | 6/1954 | Keely | 15/167.2 |
| 3,350,737 | 11/1967 | Makowsky | 15/172 |
| 3,592,188 | 7/1971 | Barnett | 15/22.1 |
| 3,691,587 | 9/1972 | Makowsky | 15/172 |
| 5,432,971 | 7/1995 | Chung | 15/172 |

*Primary Examiner*—Gary K. Graham
*Attorney, Agent, or Firm*—Bacon & Thomas

[57] ABSTRACT

A pair of brush heads of a toothbrush may be positioned adjacent each other to define a single brush surface or facing each other to define a pair of opposed brush surfaces by slidable engagement between a V-shaped groove of a movable push block and a pair of oppositely directed spiral ribs on a pair of rolling rods supporting the brush heads, so that the single brush surface may be used to clean the front teeth and the opposed brush surfaces may be used to clean the back teeth.

5 Claims, 5 Drawing Sheets

TOOTHBRUSH WITH ADJUSTABLE DOUBLE BRUSH HEADS

BACKGROUND OF THE INVENTION

1. Field of the Invention

The present invention relates to a toothbrush structure with double brush heads, and especially to a toothbrush wherein by pushing a push block, the closing and separating of two brush head rods may be controlled to provide the dual functions of a single brush surface and a double brush surface, and wherein the single brush surface may be used to clean the inside and outside of the front teeth, while the double brush surface is used to clean the back teeth. Thus, the cleaning function of a toothbrush is improved.

2. Description of the Prior Art

Generally speaking, since the invention of the toothbrush, the shape and function of the toothbrush have not been vastly improved. The main components of a generally used toothbrush include a brush bristle head and a handle. However, this structure has not been changed dramatically. There is an electric toothbrush, but this structure still has a single brush surface.

The main structure of a single brush surface toothbrush mainly uses brush bristles to clean the tartar from the teeth surfaces and gaps between the teeth. However, the width of the brush is limited, and it is only convenient for use in cleaning the front teeth. It is not easy to clean the teeth located deeply within the mouth cavity, such as the molar and wisdom teeth. Therefore, a diamond-shaped small headed toothbrush or a short bristle toothbrush may be used, but the cleaning effect of these devices is still limited.

Accordingly, the toothbrushes in the prior art still have the above-described disadvantages.

SUMMARY OF THE INVENTION

The primary object of the present invention is to provide a toothbrush structure with an adjustable double brush head, and especially a changeable brush head configuration which can function as a single brush surface and a double brush surface. The single brush surface is used to clean the inside and outside of the front teeth, while the double brush surface is used to clean the two sides of the back teeth, such as the molar teeth and wisdom teeth.

In order to realize this objective, the toothbrush of the present invention is mainly comprised of a body, a push block and a pair of brush head rods, wherein the body has a cavity provided with a front cover having a rectangular opening formed therein. The push block has a driving means on its back side and a pushing member mounted on its front side. The two brush head rods are each provided with a bristle assembly which are positioned left and right and each has a brush surface that is half the width of a conventional brush surface. The lower portion of each brush head rod is connected with a rolling rod.

The rolling rods of the two brush head rods are located within the cavity of the body and the upper ends thereof are positioned with a movable push block disposed in operational engagement with the rods. By moving the push block between two positions, the brush heads are either disposed adjacent each other to define a single brush surface or facing each other to define a double brush surface.

The invention, as well as its many advantages, may be further understood by the following detailed description and drawings.

DETAILED DESCRIPTION OF THE PREFERRED EMBODIMENT

Figure 1:
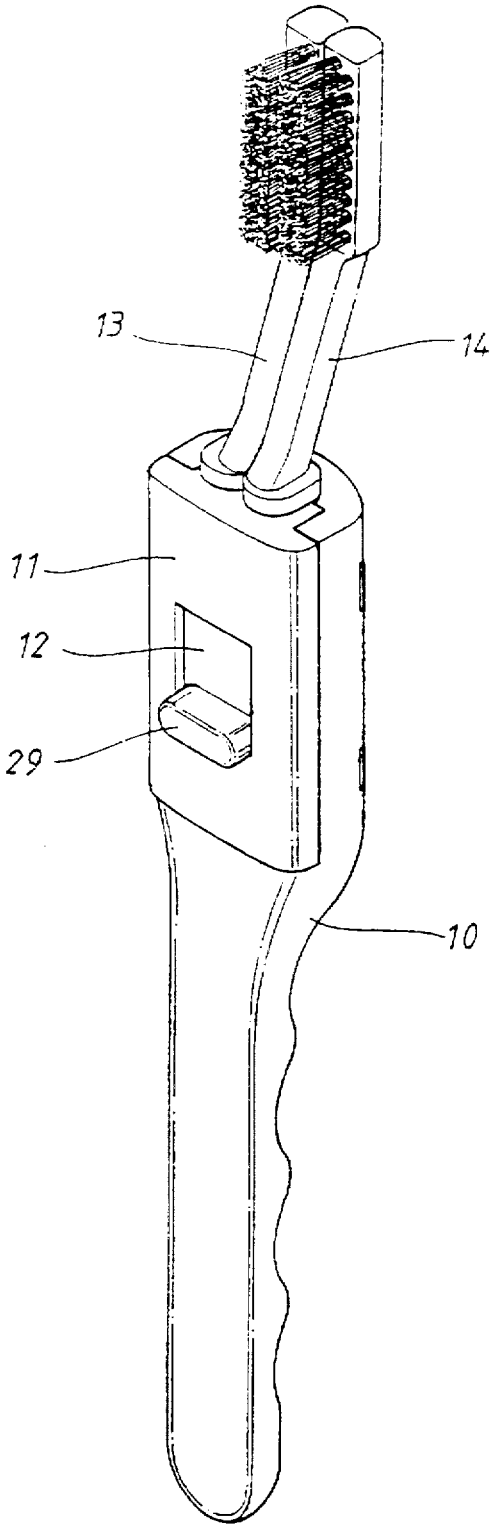
FIG. 1 is a perspective view of a toothbrush according to the preferred embodiment of the present invention.
Figures 2, 2A:
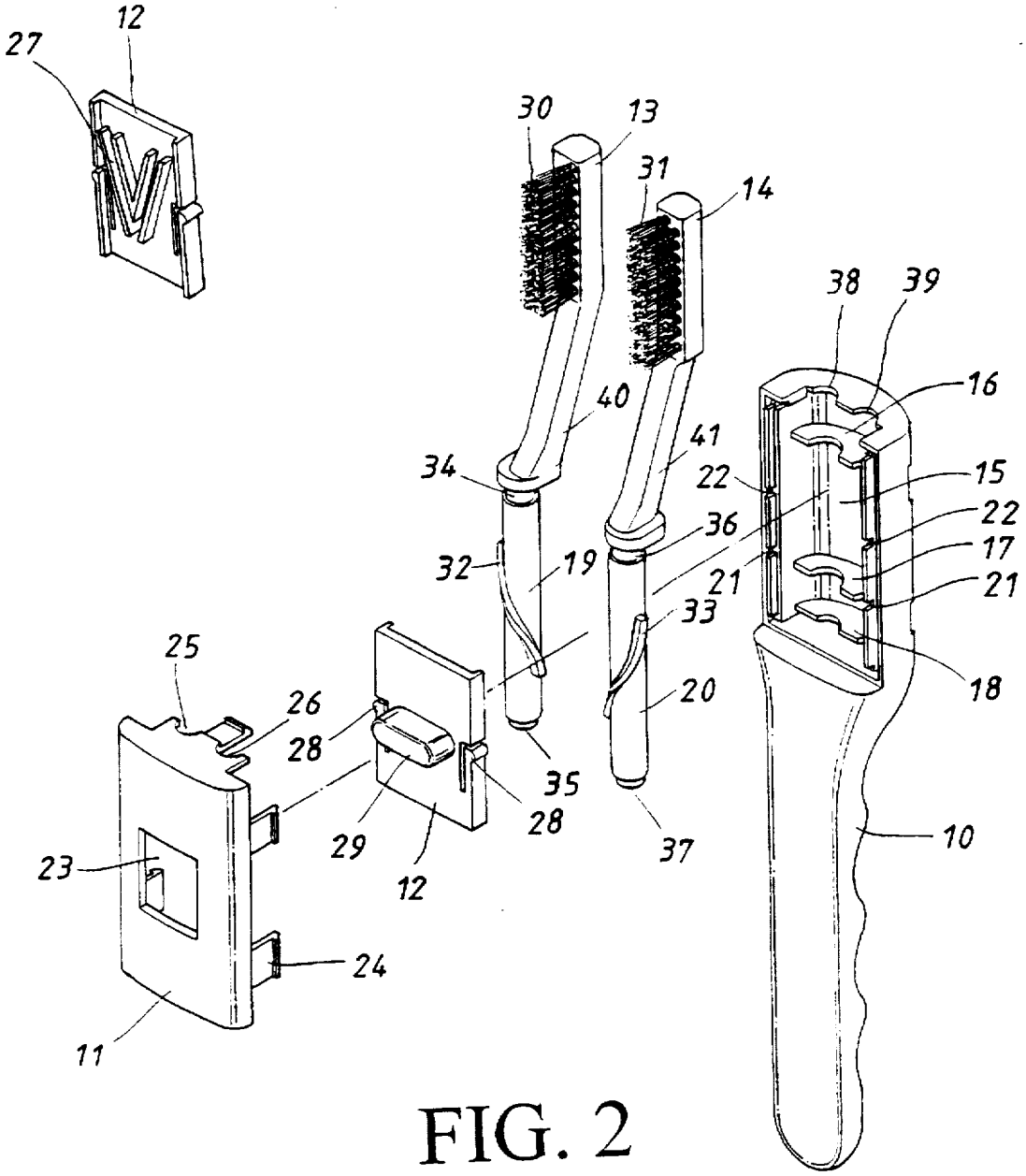
FIG. 2 is an exploded perspective view of the preferred embodiment.
FIG. 2A is an enlarged view showing the driving means on the back side of the push block.

Referring first to the views shown by FIG. 1 and FIG. 2, the invention is mainly comprised of a body (10), a cover (11), a push block (12) and a pair of brush bristle rods (13) and (14). The body (10) has a cavity (15) defined therein for receiving a plurality of rib pieces (16), (17), and (18) with each piece having two semicircular recessed portions for locating two rolling rods (19) and (20). A pair of right and left side edges are provided with a pair of lower engagement notches (21) and a pair of upper engagement notches (22).

The center of cover (11) has a rectangular opening (23) and a plurality of spaced rearwardly extending tenons (24) for engaging the sides of cavity (15). The top end of cover (11) has two semicircular recesses (25) and (26). The push block (12) has a driving means on its back side in the form of a V-shaped groove (27) and the two sides of block (12) are each provided with an engagement portion (28). The front side of block (12) has a pushing member (29) for moving block (12). The brush head set is formed by two brush head rods (13) and (14) which are positioned left and right and extend vertically. The rods (13) and (14) each have a bristle assembly (30) and (31), respectively. Each bristle assembly (30) and (31) is only one-half the width of the bristle assembly in the prior art toothbrush.

The lower ends of rods (13) and (14) are connected to the upper ends of a pair of rolling rods (19) and (20), respectively, by a pair of rearwardly angled extension rods (40) and (41). The surface of each rolling rod (19) and (20) includes a spiral rib (32) and (33), respectively. Ribs (32) and (33) extend longitudinally and spirally around rods (19) and (20) in opposite directions through 180 degrees and collectively define a V-shaped configuration corresponding to the V-shaped groove (27) of block (12). Four annular recesses (34), (35), (36) and (37) are provided on the upper and lower ends of rods (19) and (20). The upper annular recesses (35) and (37) are engaged within a pair of semicircular recesses (38) and (39) on the top end of body (10) and are also clamped by the two semicircular recesses (25) and (26) of cover (11), thereby rotatably securing rods (19) and (20) within cavity (15).

Figure 3:
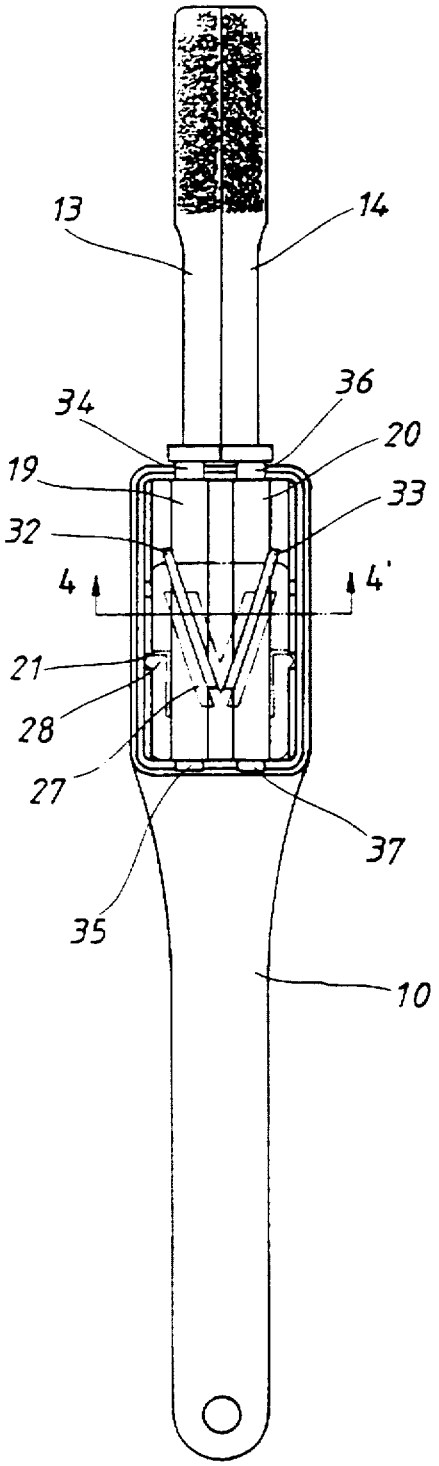
FIG. 3 is a front elevational view of the preferred embodiment showing the brush heads in a first position defining a single brush surface.
Figure 4:
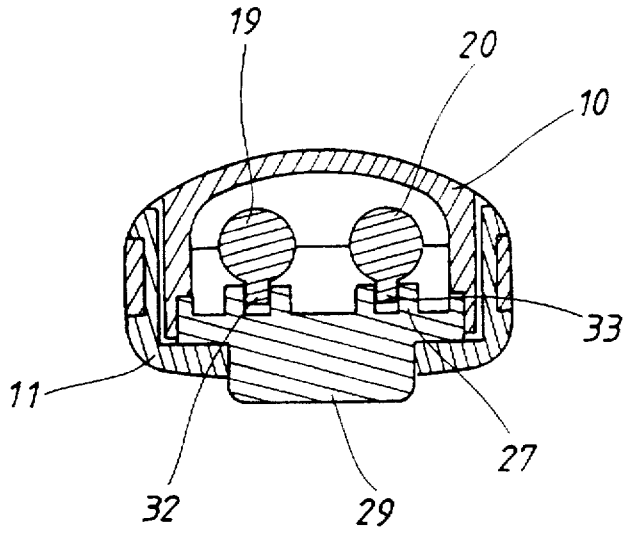
FIG. 4 is a cross-sectional view taken along the line 4—4 of FIG. 3.
Figure 5:
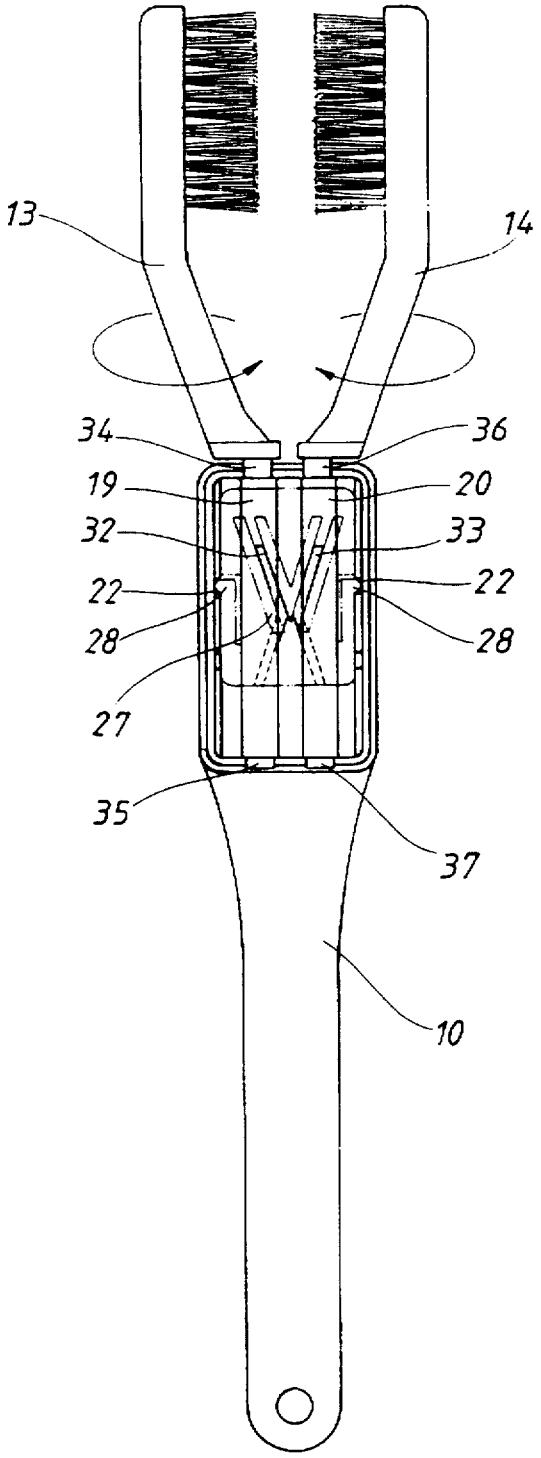
FIG. 5 is a front elevational view of the preferred embodiment showing the brush heads in a second position defining a double brush surface.

Now referring to FIGS. 3, 4 and 5, in which rolling rods (19) and (20) are shown positioned within the semicircular recessed portions of rib pieces (16) and (17). Push block (12) is located so that the V-shaped groove (27) is positioned across and engaged by the right and left convex ribs (32) and (33), and the engagement portions (28) are engaged within lower engagement notches (21). When block (12) is covered by cover (11), pushing member (29) of block (12) is projected through opening (23) of cover (11). Upon pushing block (12) upwards, the V-shaped groove (27) slides along the right and left convex ribs (32) and (33), thereby causing the rolling rods (19) and (20) to be rotated in opposite directions. Since the extension rods (40) and (41) are angled rearwardly, the two brush head rods (13) and (14) are separated gradually. When the engagement portions (28) of push block (12) move upwardly and engage upper notches (22), the rolling rods (19) and (20) are each exactly rotated 90 degrees, and the two brush bristle rods (13) and (14) are positioned exactly opposite each other. This forms a gap between the surfaces of the bristle assemblies (30) and (31), as seen in FIG. 5, and results in a double brush surface which may be used to clean the inside and outside of the back teeth, including the molar and wisdom teeth. Furthermore, since the width of the entire brush head in this separated condition is only one-half that of the original unseparated brush head, it may conveniently extend into those portions of the mouth which are somewhat inaccessible to a toothbrush. When push block (12) is moved back to its original position, rods (19) and (20) will rotate in the reverse opposite directions to restore brush heads (13) and (14) to the original positions shown in FIG. 1.

Changes and modifications in the above-described preferred embodiment of the invention can, of course, be resorted to without departing from the spirit and scope thereof, and the invention is intended to be limited only by the scope of the appended claims.

I claim:

1. A toothbrush with adjustable double brush heads comprising:

a) a brush body having a cavity formed therein;

b) a pair of rolling rods disposed within the cavity and supported for rotary movement in opposite directions from each other, each rolling rod including a first driving means;

c) a pair of extension rods positioned exteriorly of the body, each extension rod being connected to a rolling rod and angled outwardly therefrom;

d) a brush head rod on each extension rod and a bristle assembly carried by each brush head rod;

e) a push block mounted to the body for slidable movement between a first position and a second position, the push block including a second driving means disposed in operative engagement with the first driving means of the rolling rods; and f) wherein movement of the push block to the first position causes rotation of the rolling rods in first opposite directions to position the bristle assemblies in a side-by-side configuration for defining a single brush surface and movement of the push block to the second position causes rotation of the rods in reverse opposite directions to position the bristle assemblies in a face-to-face configuration for defining a double, brush surface.

2. The toothbrush of claim 1 wherein the second driving means includes a V-shaped groove on the push block and the first driving means includes a pair of ribs extending longitudinally and spirally along the rolling rods in opposite directions through approximately 180 degrees to define a V-shaped configuration corresponding to the V-shaped configuration of the groove.

3. The toothbrush of claim 1 further including a cover enclosing the cavity, the cover having an opening formed therethrough, the push block being disposed within the cavity and including a pushing member extending outwardly through the opening for engagement by a user.

4. The toothbrush of claim 3 further including:

a) a plurality of rib pieces positioned in the cavity, each rib piece including a pair of semicircular recessed portions, the rolling rods being located for rotational movement within the semicircular recessed portions;

b) the cover includes a top end having a pair of semicircular recesses formed therein, the body includes a top end having a pair of semicircular recesses formed therein, the semicircular recesses of the cover and body being disposed in engagement around a pair of top ends of the rolling rods; and c) the push block includes a pair of outwardly extending engagement portions, the body includes an upper pair of engagement notches and a lower pair of engagement notches, the engagement portions being selectively engageable within the lower and upper engagement notches to dispose the push block in the respective first and second positions.

5. The toothbrush of claim 3 wherein the cover further includes a plurality of tenons for securing the cover to the body.

* * * * *